US007740044B2

(12) United States Patent
Gutierrez

(10) Patent No.: US 7,740,044 B2
(45) Date of Patent: Jun. 22, 2010

(54) AWNING ASSEMBLY INCLUDING DROP-DOWN SHADE

(75) Inventor: Roberto Gutierrez, El Paso, TX (US)

(73) Assignee: Dometic, LLC, Elkhart, IN (US)

( * ) Notice: Subject to any disclaimer, the term of this patent is extended or adjusted under 35 U.S.C. 154(b) by 207 days.

(21) Appl. No.: 11/468,817

(22) Filed: Aug. 31, 2006

(65) Prior Publication Data

US 2008/0093030 A1 Apr. 24, 2008

(51) Int. Cl.
*E04F 10/02* (2006.01)

(52) U.S. Cl. ..... 160/56; 160/58.1; 160/67; 160/120; 160/121.1; 160/122; 135/88.1

(58) Field of Classification Search ..... 160/56, 160/58.1, 67, 120, 121.1, 122; 135/88.1, 135/88.11, 88.12
See application file for complete search history.

(56) References Cited

U.S. PATENT DOCUMENTS

| | | | | | |
|---|---|---|---|---|---|
| 4,214,621 | A * | 7/1980 | Wessels et al. | ..... | 160/66 |
| RE30,664 | E * | 7/1981 | Upton et al. | ..... | 160/66 |
| 5,170,811 | A * | 12/1992 | Kirk et al. | ..... | 135/88.11 |
| 5,560,411 | A * | 10/1996 | Becker | ..... | 160/67 |
| 5,647,421 | A * | 7/1997 | Hoffmann et al. | ..... | 160/120 |
| 5,718,253 | A | 2/1998 | McNamee | | |
| 5,819,830 | A * | 10/1998 | Verelst | ..... | 160/22 |
| 5,860,440 | A | 1/1999 | Murray et al. | | |
| 5,924,465 | A * | 7/1999 | Malott | ..... | 160/67 |
| 5,934,349 | A * | 8/1999 | Faller | ..... | 160/127 |
| 6,098,692 | A * | 8/2000 | Dieckmann | ..... | 160/66 |
| 6,131,990 | A | 10/2000 | Crean | | |
| 6,216,714 | B1 | 4/2001 | Tucker | | |
| 6,260,909 | B1 | 7/2001 | Crean et al. | | |
| 6,279,641 | B1 * | 8/2001 | Malott | ..... | 160/67 |
| 6,363,664 | B1 | 4/2002 | Brutsaert | | |
| 6,457,508 | B1 | 10/2002 | Tomita | | |
| 6,494,246 | B1 | 12/2002 | Blevins | | |
| 7,353,855 | B2 * | 4/2008 | Collishaw | ..... | 160/44 |
| 7,549,455 | B2 * | 6/2009 | Harper et al. | ..... | 160/121.1 |
| 2005/0072532 | A1 | 4/2005 | Holden et al. | | |
| 2006/0191646 | A1 * | 8/2006 | Harper et al. | ..... | 160/84.05 |

(Continued)

OTHER PUBLICATIONS

Dictionary.com. Dictionary.com Unabridged (v 1.1). Random House, Inc. http://dictionary.reference.com/browse/awning.*

*Primary Examiner*—Katherine W Mitchell
*Assistant Examiner*—Philip S Kwon
(74) *Attorney, Agent, or Firm*—Pearne & Gordon LLP

(57) ABSTRACT

The primary roller of an awning assembly has an internal cavity, an opening between the internal cavity and the exterior of the primary roller and a first arresting element. A first awning material is adapted to be unwound from the primary roller when the primary roller rotates in a first direction and wound onto the primary roller when the primary roller rotates in a second direction. A secondary roller is mounted for rotation within the internal cavity of the primary roller. One end of a second awning material attached to the secondary roller extends through the opening in the primary roller. A second arresting element is attached to the one end of the second awning material and is adapted to engage the first arresting element of the primary roller, whereby rotation of the secondary roller in the second direction causes the primary roller to rotate in the second direction together with the secondary roller.

10 Claims, 3 Drawing Sheets

U.S. PATENT DOCUMENTS

2007/0079943 A1* 4/2007 Smith et al. ..... 160/121.1
2008/0087384 A1* 4/2008 Gutierrez ..... 160/67
2008/0093030 A1* 4/2008 Gutierrez ..... 160/67
2008/0223532 A1* 9/2008 Auger ..... 160/292
2008/0308238 A1* 12/2008 Ito ..... 160/67

* cited by examiner

AWNING ASSEMBLY INCLUDING DROP-DOWN SHADE

BACKGROUND OF THE INVENTION

The present invention in general concerns awning assemblies, and, in particular, the invention concerns awning assemblies that include both a main awning component and an auxiliary awning component such as a drop-down shade or flyer.

Awning assemblies that are applied to various structures such as store-fronts and recreational vehicles, for example, often include both a main awning section that can be supported at and deployed from the structures as well as a secondary awning section, in the nature of a drop-down shade or flyer, that can be deployed from the end of the main awning section that is furthest removed from the structures when the main awning section is deployed. The secondary awning section, particularly where it can be deployed over a range of lengths, can provide additional protection from the sun and elements such as wind and rain.

Often times, the awing assemblies are contained in housings that are mounted at the structures. Typically the awning fabric of the main awning section is wound and unwound on a roller for storage in such a housing and deployment, respectively. In many cases the main awning section is supported in a deployed state by folding support arms that are secured at the structures and at the rollers on which the awning fabric of the main awning section is wound and unwound. The main awning section can also be supported when it is deployed by supports that rest on the ground.

A variety of constructions can be provided for deployment of the secondary awning sections that are associated with the main awning sections. In some instances provisions are made so that the secondary awning sections can be extended from the main awning sections over a range of lengths and thereby provide a selective degree of protection from the sun, wind, rain and the like.

SUMMARY OF THE INVENTION

According to one aspect of the invention, there is provided an awning assembly that is adapted to be mounted at a structure. The awning assembly comprises a primary roller with a first awning material and a secondary roller with a second awing material. The primary roller has an internal cavity within at least a portion of the primary roller, an opening between the internal cavity and the exterior of the primary roller and a first arresting element. The primary roller is adapted to rotate around its longitudinal axis in a first direction and in a second direction opposite to the first direction. The first awning material has a first end and a second end. The first awning material is attached adjacent its first end to the primary roller and is adapted to be secured adjacent its second end at the structure. The first awning material also is adapted to be unwound from the primary roller when the primary roller is rotated in the first direction and wound onto the primary roller when the primary roller is rotated in the second direction. The secondary roller is mounted within the internal cavity of the primary roller substantially coaxially with the primary roller for rotation within the internal cavity around the longitudinal axis of the second roller in the first direction independently of the primary roller and in the second direction selectively independently of the primary roller and together with the primary roller. The second awning material has a first end and a second end. The second awning material is attached adjacent its first end to the secondary roller and the second end of the second awning material extends through the opening in the primary roller between the internal cavity and the exterior of the primary roller. The second awning material is adapted to be unwound from the secondary roller when the secondary roller is rotated in the first direction and wound onto the secondary roller when the secondary roller is rotated in the second direction. A second arresting element is attached adjacent the second end of the second awning material and is adapted to engage the first arresting element of the primary roller, whereby, upon engagement of the first and second arresting elements, rotation of the secondary roller in the second direction causes the primary roller to rotate in the second direction together with the secondary roller.

According to another aspect, the opening in the primary roller extends along a substantial portion of the length of the primary roller and is substantially parallel to the longitudinal axis of rotation of the primary roller.

According to a further aspect, the first arresting element is located at the opening in the primary roller.

According to still another aspect, the first arresting element comprises a shoulder that projects inwardly of the exterior of the primary roller towards the exterior of the secondary roller to form an arresting space between the shoulder and an outermost wrap of the second awning material when the second awning material is wound onto the secondary roller to the maximum extent of the second awning material.

According to yet another aspect, the second arresting element is larger than the arresting space between the shoulder of the first arresting element and the outermost wrap of the second awning material when the second awning material is wound onto the secondary roller to the maximum extent of the second awning material.

According to another aspect, the second arresting element is a cylindrical rod that extends along a substantial portion of the second awning material.

According to a further aspect, the first roller comprises a cylindrical shell. Additionally, the second roller can comprise a cylindrical shell. Where the primary roller comprises a cylindrical shell, the shoulder of the primary roller can comprise a portion of the primary roller cylindrical shell that is turned inwardly toward the exterior of the secondary roller.

DETAILED DESCRIPTION OF AN EMBODIMENT OF THE INVENTION

Figure 1:
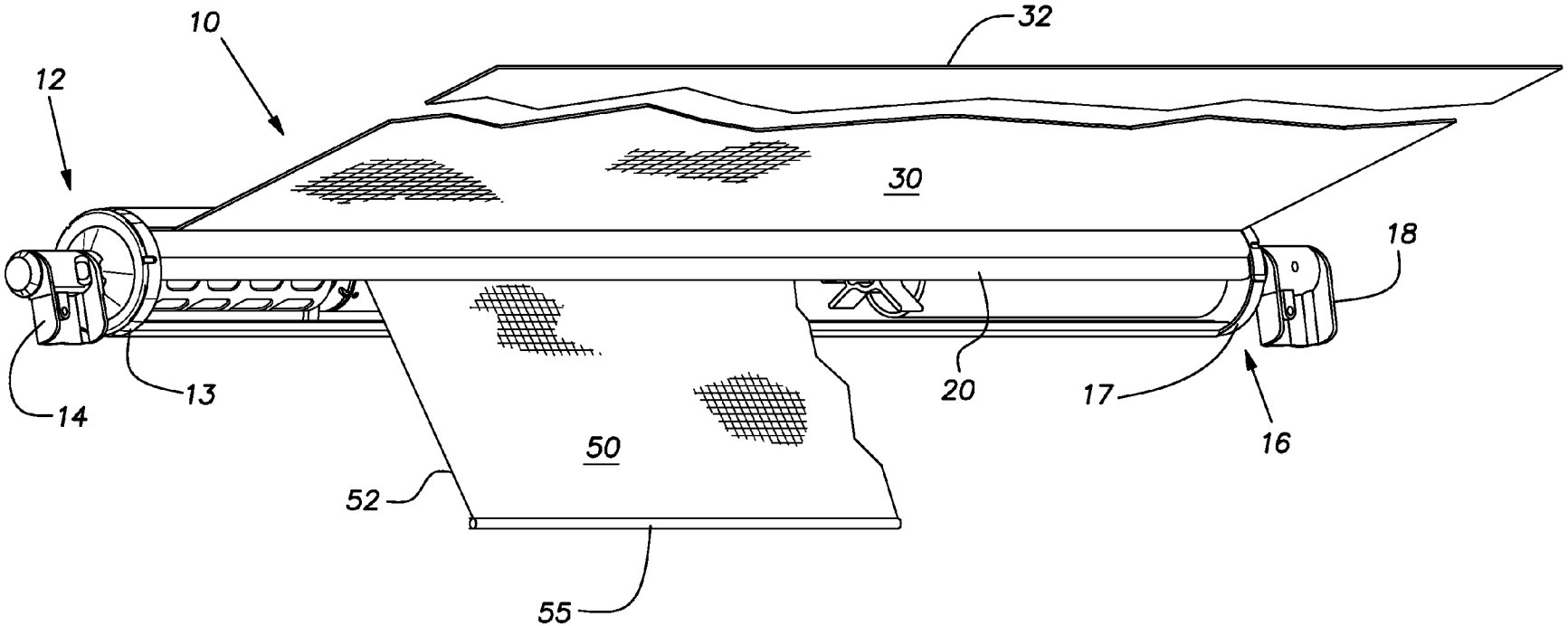
FIG. 1 is a perspective view of one embodiment of the awning assembly of the invention.

FIG. 1 of the drawings illustrates an awning assembly, indicated generally at 10, in accordance with an embodiment of the present invention. The awning assembly is shown as attached at a first end 12 to a bracket 14 and at a second end 16 to a bracket 18. The brackets 14 and 18 can each be connected to ends of folding extension arms (not shown) that are secured at a structure such as a store front, residence, recreational vehicle or the like, for example, for the purpose of supporting the awning assembly, particularly when the awning assembly is deployed. The manner in which the folding extension arms are operatively connected to the awning assembly and the structure and are unfolded as the awning assembly is deployed, so as to support the awning assembly, is known to those having ordinary skill in the art and is not described in detail here. It will also be understood by those skilled in the art that a housing with a frontal opening adequate to accommodate the awning assembly 10 and the folding extension arms can be secured to the structure to provide a storage area for the awning assembly and the extension arms when the awning assembly is not deployed.

The awning assembly can also be supported when it is deployed by alternative supporting structures such as support posts for example that can be secured at one of their ends to the ends of the awning assembly in place of the folding extension arms and the brackets 14 and 18. As will be understood by those skilled in the art, the other ends of the support posts can rest on the ground or be secured to the structure at which the awning assembly is mounted.

The awning assembly of the invention in general has application wherever awning assemblies can be used. Thus, as indicated above, the awning assembly of the invention can be applied to stationary structures such as residences, where it may be used to provide shade or protection from the elements over an outdoor patio for example. The awning assembly of the invention can also be applied to mobile structures such as recreational vehicles for example. The recreational vehicles can comprise mobile homes, motor homes, travel trailers, fifth wheelers, recreational vans and the like. It will therefore be understood that the awning assembly of the present invention is adapted to be employed with a variety of structures.

Figure 2:
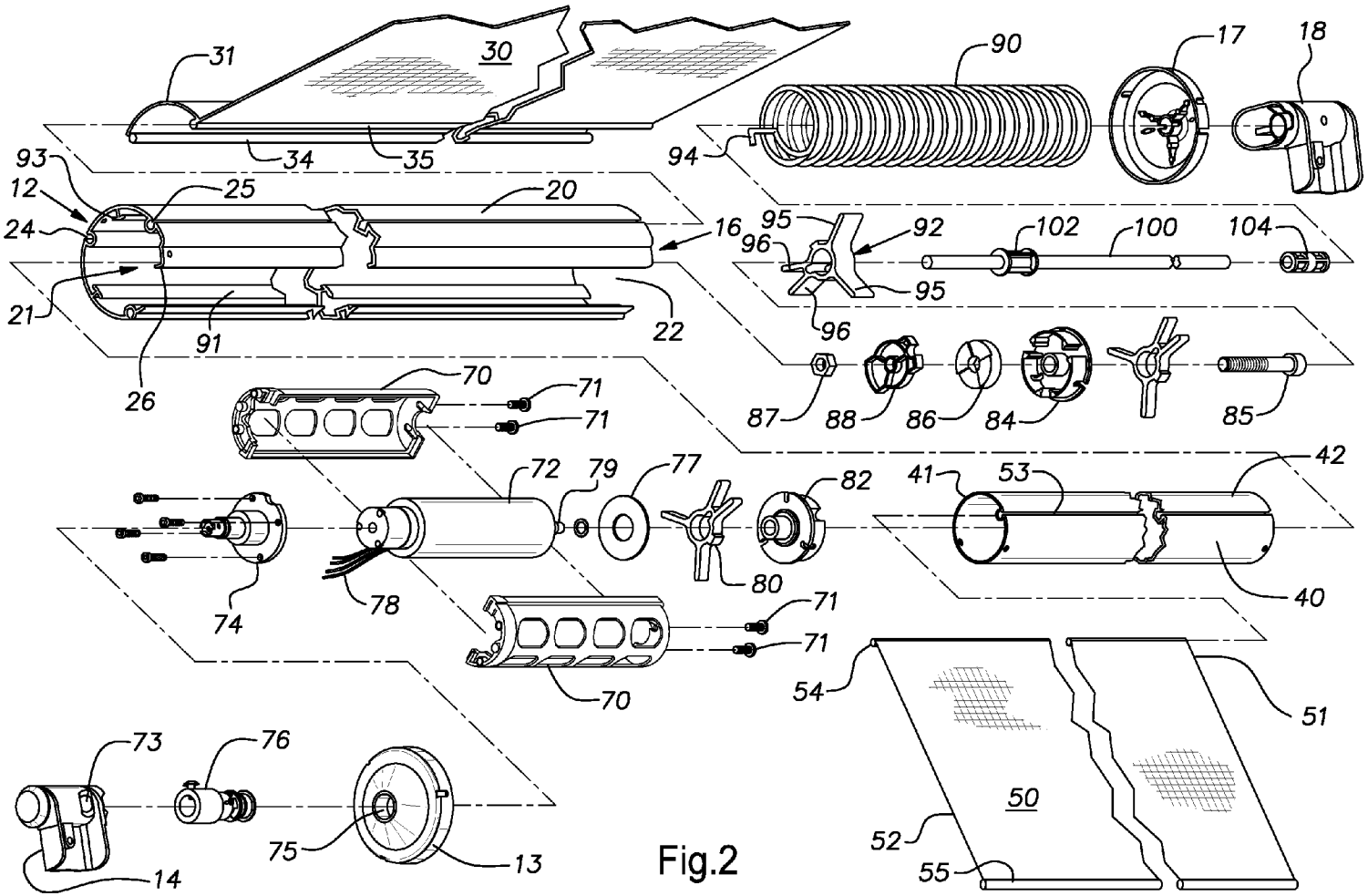
FIG. 2 is an exploded view of the embodiment of the invention shown in FIG. 1.

Referring to FIGS. 1 and 2, it can be seen that the awning assembly comprises a primary roller 20, a first awning material 30, a secondary roller 40 and a second awning material 50. The primary roller 20 has an internal cavity within at least a portion of the primary roller. In the embodiment shown in the drawings, the primary roller comprises a cylindrical shell that can be made of a hard plastic or a metal for example so that the primary roller's internal cavity extends the full length of the primary roller.

The primary roller 20 is adapted to rotate around its longitudinal axis that extends from the first end 12 to the second end 16 of the primary roller. As further described below, the primary roller is adapted to rotate around its longitudinal axis in a first direction when the awning assembly is deployed from the structure at which it is mounted and in a second direction opposite to the first direction when the awning assembly is returned to the structure at which it is mounted. The primary roller 20 includes an opening between the internal cavity and the exterior of the primary roller. The opening in the primary roller 20 can extend along a substantial portion of the length of the primary roller and can be substantially parallel to the longitudinal axis of rotation of the primary roller. In the embodiment of the invention illustrated in the drawings, as best shown in FIG. 2, the opening 22 between the internal cavity 21 and the exterior of the primary roller 20 extends the entire length of the primary roller, is parallel to the longitudinal axis of rotation of the primary roller and is created by not having the cylindrical shell completely closed.

The first awning material 30, which can comprise any type of awning fabric or the like, has a first end 31 and a second end 32. The first awning material is attached adjacent its first end 31 to the primary roller 20 and is adapted to be secured adjacent its second end 32 at the structure at which the awning assembly is mounted. As best seen in FIGS. 2 through 5, for attaching the first awning material to the primary roller 20, cylindrical recesses 24 and 25 are provided in the exterior of the primary roller from the first end 12 to the second end 16 of the primary roller and hold in place dowel-like elements 34 and 35, respectively, that are attached to the first awning material 30 adjacent the first end 31 of the first awning material.

Figure 3:
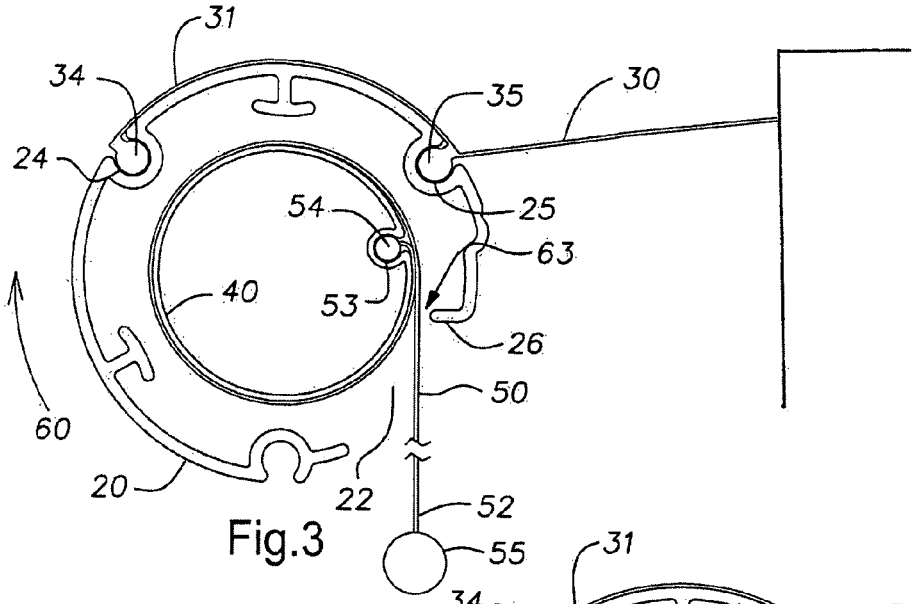
FIG. 3 is an end view of the embodiment of the invention shown in FIG. 1 with certain parts removed to better illustrate the relationship between the primary and secondary rollers when the first awning material is fully unwound from the primary roller and the second awning material is partially unwound from the secondary roller.
Figure 5:
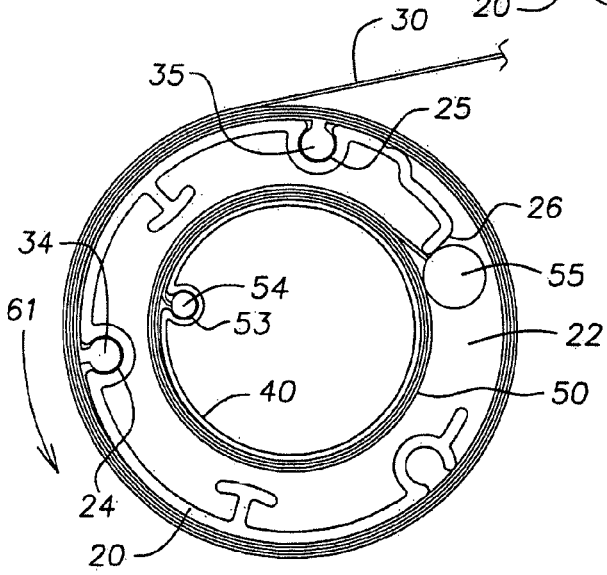
FIG. 5 is an end view of the embodiment of the invention similar to FIGS. 3 and 4 after additional rotation of the secondary roller following the engagement of the arresting elements has caused the first awning material to be wound onto the primary roller.

The first awning material 30 is adapted to be unwound from the primary roller 20 when the primary roller is rotated in the first direction as indicated by the directional arrow 60 in FIG. 3, such as would be the case when the awning assembly is deployed from the structure at which it is mounted, and wound onto the primary roller 20 when the primary roller is rotated in the second direction as indicated by the directional arrow 61 in FIG. 5 such as when the awning assembly after having been deployed is returned to the structure.

The secondary roller 40 is mounted within the internal cavity 21 of the primary roller 20 substantially coaxially with the primary roller and has a first end 41 and a second end 42. The secondary roller can comprise a cylindrical shell made of a hard plastic or a relatively rigid metal for example. The secondary roller 40 is mounted for rotation within the internal cavity around the longitudinal axis of the secondary roller that extends from the first end 41 to the second end 42 of the secondary roller such that rotation of the secondary roller 40 in the first direction 60 results in rotation of the secondary roller 40 independently of the primary roller 20 and rotation of the secondary roller in the second direction 61 selectively results in the rotation of the secondary roller 40 independently of the primary roller 20 or in the rotation of the secondary roller together with the rotation of the primary roller. Further details concerning the mounting of the secondary roller within the cavity of the primary roller and the operational relationship between the primary and secondary rollers are set forth below.

The secondary awning material 50 also can comprise any type of awning fabric or material. The secondary awning material has a first end 51 and a second end 52. The second awning material is attached adjacent its first end 51 to the secondary roller 40. As can be seen in FIGS. 2 through 5, in the illustrated embodiment, a cylindrical recess 53 extends along the length of the secondary roller from the first end 41 to the second end 42 of the secondary roller. A dowel-like element 54 is attached adjacent the first end 51 of the second awning material 50 and is held in place in the cylindrical recess 53. The second end 52 of the second awning material 50 extends through the opening 22 in the primary roller 20 between the internal cavity 21 and the exterior of the primary roller. As further described below, the second awning material 50 is adapted to be unwound from the secondary roller 50 when the secondary roller is rotated in the first direction 60 and wound onto the secondary roller when the secondary roller is rotated in the second direction 61.

Figure 4:
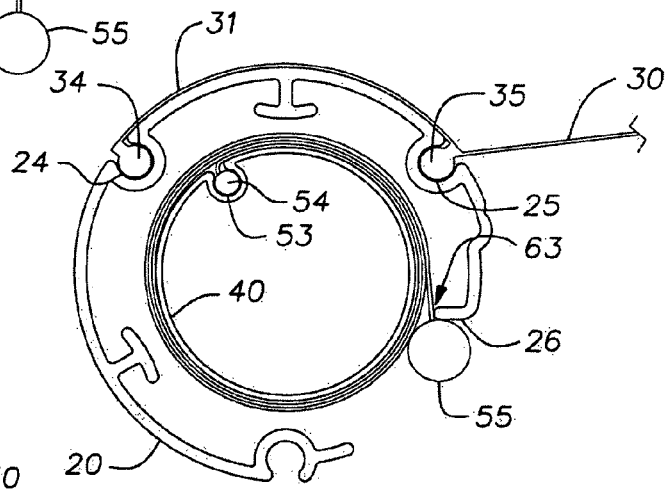
FIG. 4 is an end view of the embodiment of the invention similar to FIG. 3 but with the second awning material wound onto the secondary roller to the point that the arresting elements of the primary roller and the second awning material are in engagement with one another.

The primary roller 20 and the second awning material 50 include a first arresting element and a second arresting element, respectively, whereby, upon engagement of the first and second arresting elements, rotation of the secondary roller 40 in the second direction 61 causes the primary roller 20 to rotate in the second direction along with the secondary roller 40. In the embodiment of the invention shown in the drawings, the first arresting element 26 on the primary roller 20 is located at the opening 22 in the primary roller. As best seen in FIG. 4, the first arresting element comprises a shoulder 26 that projects inwardly of the exterior of the primary roller 20 towards the exterior of the secondary roller 40 to form an arresting space 63 between the shoulder 26 and an outermost wrap of the second awning material 50 when the second awning material is wound onto the secondary roller 40 to the maximum extent of the second awning material. In the embodiment shown in the drawings, the shoulder 26 of the primary roller comprises a portion of the primary roller cylindrical shell that is turned inwardly toward the exterior of the secondary roller 40.

The second arresting element included with the second awning material 50 is larger than the arresting space 63 between the shoulder of the first arresting element 26 and the outermost wrap of the second awning material 50 when the second awning material is rolled onto the secondary roller 40 to the maximum extent of the second awning material. In the embodiment shown in the drawings, the second arresting element comprises a cylindrical rod 55 that extends along a substantial portion of the second awning material and can extend along the entire width of the second awning material as best seen in FIG. 2.

The first and second arresting elements can be other than as described above and illustrated in the drawings. Other types of arrangements where the secondary roller seizes the primary roller so as to rotate the primary roller can be used. For example, the awning material 50 can be provided at its second end 52 with hooks that hook onto the primary roller.

Based on the foregoing description, further details can now be presented with reference to the operational features of the embodiment of the invention as shown in FIGS. 3, 4 and 5 of the drawings. FIGS. 3, 4 and 5 are end views of the awning assembly shown with various elements removed so as to better illustrate the operational relationships among the primary and secondary rollers, the first and second awning materials and the first and second arresting elements.

FIG. 3 illustrates the condition of the awning assembly after it has been deployed from the structure at which it is mounted and the second awning material, in the nature of a drop-shade or flyer for example, also has been deployed a selected extent. FIG. 4 illustrates the condition of the awning assembly when the awning assembly is to be returned to the structure at which it is mounted and drop shade or flyer has been wound on the secondary roller until the first and second arresting elements are in engagement. FIG. 5 of the drawings illustrates the condition after the first awning material has been wound on the primary roller and the awning assembly has been returned to the structure at which it is mounted.

As will be understood, after the awning assembly has been deployed as illustrated in FIG. 3, the first awning material 30 will have been unwound from the primary roller 20 by the rotation of the primary roller in the direction shown by the directional arrow 60. Once the primary roller reaches a deployed condition, the second awning material 50 will be unwound to a desired degree from the secondary roller 40 by the rotation of the secondary roller in the direction shown by the directional arrow 60. At such time as it is desired to return the awning assembly to the structure at which it is mounted, the second awning material 50 is wound onto the secondary roller 40 by the rotation of the secondary roller in the direction shown by the directional arrow 61. As the second awning material 50 is wound on the secondary roller 40 and the wraps of the second awning material accumulate on the secondary roller, the space 63 between the shoulder 26 of the primary roller 20 and the outermost wrap becomes smaller. Finally, as the dowel 55 on the second awning material 50 reaches the shoulder 26 on the primary roller, the space 63 is so small as to prevent the dowel 55 from passing through the space. As a result, continued rotation of the secondary roller 40 in the direction shown by the directional arrow 61 will cause the primary roller 20 to rotate in the same direction. The first awning material 30 will thereby be wound onto the primary roller 20 until the first awning material and the second awning material are completely wound on their respective rollers as illustrated in FIG. 5 and the awning assembly is returned to the structure at which it is mounted.

It will be understood by those having ordinary skill in the art, that the awning assembly described above can be provided with a variety of means for unwinding and winding of the awning assembly. For example, an electric motor as described in greater detail below can be employed. By way of further example, a mechanical cranking arrangement can be used to wind and unwind the awning assembly.

Referring now in particular to FIG. 2 for one example of the manner in which an electric motor can be incorporated into the awning assembly, reference is first had to the primary roller 20 of the awning assembly. As previously described, the primary roller comprises a cylindrical shell to which is attached the first awning material 30. Mounted within the cavity 21 of the primary roller is a cylindrical housing comprising two substantially matching half-cylinder components 70. An electric motor 72 is held within the housing and the half-cylinder components of the housing are held together at one end by screws 71 and a washer 77. A connector 74 is screwed to the opposite end of the housing and is attached to a collar 76 by means of a C-clip, snap ring or the like. One end of the collar 76 fits within a hollowed-out portion of the bracket 14 and is secured to the bracket. The other end of the collar 76 that is attached to the spacer 74 extends through the central opening 75 in the end cap 13. The lead wires 78 of the motor 72 are threaded through central bores in the spacer 74 and the collar 76 and out the opening 73 in the bracket 14. From there, the lead wires can run along the folding arms (not shown) that support the awning assembly back to a control mechanism such as a microprocessor (also not shown) that can be located on the structure at which the awning assembly is mounted.

A driving component 82 is secured to the first end 41 of the secondary roller 40 that is also located within the cavity 21 of the primary roller 20 and is fixed to the rotating shaft 79 of the motor 72. Through this arrangement, rotation of the shaft 79 rotates the secondary roller 40. A spacer 80 is located between the motor 72 and the driving component 82. The spacer includes a number of projections that engage ribs 91 and 93 and/or recesses 24 and 25 of the primary roller 20 and is thereby held in place.

The second end 42 of the secondary roller 40 is provided with a closure component 84 having a central opening that is similar in construction to the driving component 82. A mechanical stop comprising elements 86 and 88, each of which has a central opening, is located within the secondary roller shell 40. The mechanical stop and the closure component 84 are held together by means of a bolt 85 and a nut 87.

Also located within the cavity 21 of the primary roller 20 is a torsion spring 90 having a hook-like element or catch 94 at its one end. The outer diameter of the torsion spring can be such that it fits somewhat closely in the space within the primary roller 20 delimited by the cylindrical recesses 24 and 25 and inwardly projecting ribs 91 and 93 within the interior of the primary roller. A retaining clip 92 is secured to the interior of the primary roller 20 adjacent the end of the torsion spring from which the hook-like element or catch 94 depends. The clip 92 has a first pair of projections 95 and a second pair of projections 96. The first pair of projections 95 engage the ribs 91 and 93 of the primary roller 20 so that the clip 92 cannot rotate within the primary roller. At the same time, the catch 94 is hooked around one of the projections 96. This assembly functions to provide a degree of assistance to the motor 72 for the purpose of rotating roller 20 when the awning material is wound onto the roller.

A rod 100 is located within the torsion spring 90. A bushing 102 and a sleeve 104 are arranged on the rod. When the primary roller 20 rotates in the direction to deploy the awning 30, the torsion spring 90 is wound so that additional turns are created in the spring causing the length of the spring to increase. On the other hand, when the roller 20 is rotated for the purpose of winding the awning 30 onto the roller, the number of turns in the torsion spring decreases resulting in a shortening of the spring. Because the clip 92 is attached to the hook-like element 94 of the spring, the clip is displaced back and forth along the longitudinal axis of the primary roller 20. The rod 100 provides a guide for this displacement and also prevents the clip 92 from twisting. The bushing 102 allows for the back and forth movement of the spring as well as its rotation about rod 100. The sleeve 104 is part of an assembly that anchors to the rod 100 the end of the spring 90 that is opposite catch 94.

The end 16 of the primary roller 20 is closed by means of the closure cap 17 to which bracket 18 is secured. The rod 100 extends through the cap 17, which is free to rotate about the rod, and is fastened to the bracket 18. One method of fastening the rod to the bracket is to provide aligned holes in the bracket 18 and the rod 100 and a press-fit pin driven into the holes.

Based on the foregoing description, it will be understood that the awning assembly when provided with an electric motor and the components illustrated in FIG. 2 functions as follows: When the awning assembly is in a deployed condition and is to be returned to the structure at which it is mounted, the electric motor is energized so as to cause the secondary roller 40 to rotate in the direction shown by the directional arrow 61. As described above, this causes the awning material 50 to be wound on the secondary roller 40 and as the wraps of the second awning material accumulate on the secondary roller, the space 63 between the shoulder 26 of the primary roller 20 and the outermost wrap becomes smaller. Finally, as the dowel 55 on the second awning material 50 reaches the shoulder 26 on the primary roller, the space 63 is so small as to prevent the dowel 55 from passing through the space. As a result, continued rotation of the secondary roller in the direction of the directional arrow 61 will cause the primary roller 20 to rotate in the same direction. The first awning material 30 will thereby be wound onto the primary roller 20. The winding of the awning material 30 on the primary roller 20 will continue until the awning material is essentially completely wound and neither the primary roller nor the secondary roller can rotate any longer. At this time the motor will stall out. This stalled-out condition will be sensed by the microprocessor to which the lead wires 78 are connected and a motor brake will be energized so that the awning assembly can safely be stowed in the awning assembly housing. The return of the awning assembly to the structure at which it is mounted is aided by the torsion spring 90 which will have been wound to a loaded condition when the awning assembly is deployed as described above.

To deploy the awning assembly, first, the motor brake that is set when the awning assembly is stored is released. The folding extension arms (not shown) that are secured to the brackets 14 and 18 and support the awnings are spring loaded and biased towards extending the awning assembly away from the structure at which it is mounted in a manner familiar to those of ordinary skill in the art. Additionally, in some instances, the geometry of the apparatus is such that gravity will cause the awning assembly to move outwardly in a downward direction from the structure at which the awning assembly is mounted. During deployment of the awning assembly, torsion spring 90 will be wound to a loaded condition. Thus, during deployment of the awning assembly, the spring 90 will counteract the springs driving the folding extension arms and the force of gravity resulting in a smooth deployment of the awning assembly. Additionally, when the awning assembly is returned to the structure at which it is mounted, the force of rotation created by the motor 72 and the torsion spring 90 work against the force of the springs driving the folding extension arms and the force of gravity which results in a smooth return of the awning assembly to the structure at which it is mounted. When the awning material 30 is completely unwound, the motor 72 can be energized by means of the microprocessor so as to cause secondary roller 40 to rotate in the direction of the directional arrow 60, whereby the awning material 50 is unwound to a desired extent at which time the motor is turned off. In this regard, mechanical stop components 86 and 88 prevent the secondary roller 40 from continuing to rotate after the second awning material has reached its full extension thereby preventing the second awning material from rolling up in a backwards direction.

Although a particular embodiment of the invention has been described in detail above, it will be understood that the invention is not limited to that embodiment but includes all changes and modifications that are within the literal and equivalent scope of the claims that follow.

What is claimed is:

1. An awning assembly adapted to be mounted at a structure, the awning assembly comprising:

a primary roller having an internal cavity within at least a portion of the primary roller, an opening between the internal cavity and an exterior of the primary roller and a first arresting element, the primary roller adapted to rotate around its longitudinal axis in a first direction and in a second direction opposite to the first direction;

a first awning material having a first end and a second end, the first awning material being attached adjacent its first end to the primary roller and wherein the second end is mounted to the structure, the first awning material also being adapted to be unwound from the primary roller when the primary roller is rotated in the first direction and wound onto the primary roller when the primary roller is rotated in the second direction;

a secondary roller mounted within the internal cavity of the primary roller substantially coaxially with the primary roller for rotation within the internal cavity around the longitudinal axis of the second roller in the first direction independently of the primary roller and in the second direction selectively independently of the primary roller and together with the primary roller;

a second awning material having a respective first end and a respective second end, the second awning material being attached adjacent its first end to the secondary roller, the second end of the second awning material extending through the opening in the primary roller between the internal cavity and the exterior of the primary roller, the second awning material adapted to be unwound from the secondary roller when the secondary roller is rotated in the first direction and wound onto the secondary roller when the secondary roller is rotated in the second direction;

a second arresting element attached adjacent the second end of the second awning material and adapted to engage the first arresting element of the primary roller, whereby, upon engagement of the first and second arresting elements, rotation of the secondary roller in the second direction causes the primary roller to rotate in the second direction together with the secondary roller;

wherein the first arresting element comprises a shoulder that projects inwardly of the exterior of the primary roller towards an exterior of the secondary roller to form an arresting space between the shoulder and an outermost wrap of the second awning material when the second awning material is wound onto the secondary roller to the maximum extent of the second awning material; and wherein the arresting space between the shoulder and the outermost wrap of the second awning material becomes smaller as the second awning material is wound onto the secondary roller and the shoulder and outermost wrap of the second awning material prevent the passage of the second arresting element.

2. The awning assembly of claim 1 wherein the opening in the primary roller extends along a substantial portion of the length of the primary roller and is substantially parallel to the longitudinal axis of rotation of the primary roller.

3. The awning assembly of claim 2 wherein the first arresting element is located at the opening in the primary roller.

4. The awning assembly of claim 3, wherein the second arresting element is larger than the arresting space between the shoulder of the first arresting element and the outermost wrap of the second awning material when the second awning material is wound onto the secondary roller to the maximum extent of the second awning material.

5. The awning assembly of claim 4 wherein the second arresting element is a cylindrical rod that extends along a substantial portion of the second awning material.

6. The awning assembly of claim 5 wherein the primary roller comprises a cylindrical shell.

7. The awning assembly of claim 6 wherein the secondary roller comprises a cylindrical shell.

8. The awning assembly of claim 7 wherein the shoulder of the primary roller comprises a portion of the primary roller cylindrical shell that is turned inwardly toward the exterior of the secondary roller.

9. The awning assembly of claim 6 wherein the primary roller includes a plurality of cylindrical recesses for holding in place elements attached to the first awning material.

10. The awning assembly of claim 1 wherein the arresting space is formed between the first arresting element and the secondary roller.

* * * * *

UNITED STATES PATENT AND TRADEMARK OFFICE

CERTIFICATE OF CORRECTION

PATENT NO. : 7,740,044 B2
APPLICATION NO. : 11/468817
DATED : June 22, 2010
INVENTOR(S) : Gutierrez It is certified that error appears in the above-identified patent and that said Letters Patent is hereby corrected as shown below:

Column 1 line 22 “awing” should be “awning”

Column 1 line 46 “awing” should be “awning”

Signed and Sealed this
Eleventh Day of January, 2011

David J. Kappos

David J. Kappos
*Director of the United States Patent and Trademark Office*